US008139719B2

(12) United States Patent
Maack

(10) Patent No.: US 8,139,719 B2
(45) Date of Patent: Mar. 20, 2012

(54) ADD-ON-X-RAY-COLLIMATOR FOR NON-SYMMETRICAL BEAM COLLIMATION

(75) Inventor: Hanns Ingo Maack, Norderstedt (DE)

(73) Assignee: Koninklijke Philips Electronics NV, Eindhoven (NL)

( * ) Notice: Subject to any disclaimer, the term of this patent is extended or adjusted under 35 U.S.C. 154(b) by 160 days.

(21) Appl. No.: 12/530,683

(22) PCT Filed: Mar. 10, 2008

(86) PCT No.: PCT/IB2008/050860

§ 371 (c)(1), (2), (4) Date: Sep. 10, 2009

(87) PCT Pub. No.: WO2008/110977

PCT Pub. Date: Sep. 18, 2008

(65) Prior Publication Data

US 2010/0111261 A1 May 6, 2010

(30) Foreign Application Priority Data

Mar. 13, 2007 (EP) ..... 07104035

(51) Int. Cl.
*G21K 1/04* (2006.01)

(52) U.S. Cl. ..... 378/150

(58) Field of Classification Search ..... 378/147–160
See application file for complete search history.

(56) References Cited

U.S. PATENT DOCUMENTS

| | | | | |
|---|---|---|---|---|
| 3,829,701 A | | 8/1974 | Hura | 378/153 |
| 4,097,748 A | * | 6/1978 | Monvoisin | 378/146 |
| 4,277,684 A | | 7/1981 | Carson | 378/146 |
| 4,464,778 A | | 8/1984 | Goldmann | 378/150 |
| 6,393,100 B1 | * | 5/2002 | Leeds et al. | 378/150 |

FOREIGN PATENT DOCUMENTS

GB 1437511 5/1976

* cited by examiner

*Primary Examiner* — Courtney Thomas

(57) ABSTRACT

It is described a device (10) for non-symmetrical X-ray beam collimation of a X-ray tube (30), wherein the device comprises a housing (1), a X-ray absorbing plate (2) for collimating a x-ray asymmetrically, and a sleigh (3) for moving the X-ray absorbing plate. With the inventive device an asymmetrical X-ray beam can be obtained from a symmetrical X-ray beam, such that the device can be used in conventional symmetrical X-ray systems, like C-arm systems and that a better protection of a patient is reached.

4 Claims, 2 Drawing Sheets

ADD-ON-X-RAY-COLLIMATOR FOR NON-SYMMETRICAL BEAM COLLIMATION

The present invention relates to a X-ray C-arm system for radiography, especially the invention relates to an add-on-X-ray-collimator for non-symmetrical beam collimation.

In the state of the art different X-ray systems are known, however in these systems the problem arises that a symmetrical collimation is used. Thus, with these X-ray systems also regions of the human body are often irradiated, which are not intended to be exposed to X-rays. Therefore, a sufficient X-ray-protection of the patient is often not possible.

There may be a need for solving those problems of the state of the art.

This need may be met by the subject matter according to the independent claim. Advantageous embodiments of the present invention are described by the dependent claims.

According to a first aspect of the invention a device for non-symmetrical X-ray beam collimation of a X-ray tube is provided, wherein the device has a housing, a X-ray absorbing plate for collimating a X-ray asymmetrically, and a sleigh for moving the X-ray absorbing plate.

As a device for non-symmetrical X-ray beam collimation is preferably understood a device, which allows to obtain an asymmetrical, respectively non-symmetrical X-ray beam from an original symmetrical X-ray beam of a X-ray tube. The device can also be called a collimator, which preferably defines the size of a rectangular X-ray field.

By the expression symmetrical X-ray beam is preferably understood that the X-ray beam is emitted from a X-ray tube and is propagating into the space and detected on a surface of a detector. If an axis is defined in the horizontal middle of the surface of the detector, the detected symmetrical X-ray beam is symmetrical to this axis. When introducing the inventive add-on-X-ray-collimator in front of a collimator of said X-ray-tube and moving said X-ray absorbing plate towards the vertical direction of the axis on the detector, the field is no longer symmetrical to this axis. Thus, an asymmetrical or non-symmetrical X-ray beam is resulting, which is detected on the detector. In the case that a patient is situated between the X-ray tube and the detector, only the asymmetrical X-ray beam is irradiating the patient and thus an adequate X-ray-protection of the patient is obtained.

As a housing is preferably understood the part of the inventive device is attached in front of a conventional collimator of the X-ray tube. The housing of the inventive device further includes a X-ray absorbing plate and other components. The housing is attachable on the collimator of a conventional X-ray tube, which produces a symmetrical X-ray beam. Thus, the inventive add-on-X-ray-collimator is obtained.

As a X-ray absorbing plate is preferably understood a shield, which is made of lead or other strongly X-ray absorbing material and which has preferably a certain thickness, such that the symmetrical part of the X-ray beam is absorbed or cut away and a non-symmetrical X-ray beam is obtained, which is later exposed to a preferred region of the human body.

Under the expression collimating a X-ray beam asymmetrically is understood that a part of the symmetrical X-ray beam is absorbed in the X-ray absorbing plate or cut away or cancelled by the X-ray absorbing plate such that only an asymmetrical X-ray beam remains, which is further exposed to a specific part of the body of a patient.

As a sleigh is preferably understood a suitable device on the housing of the inventive device such that the X-ray absorbing plate is moveable in a vertical direction, preferably a y-direction, see FIG. 1. The sleigh is preferably fixedly mounted on the housing of the device.

With the inventive device for non-symmetrical X-ray beam collimation the advantage is obtained that a patient is protected from unwished X-ray beam or radiation in certain areas of the human body.

With a so-called "upper alignment", i.e. the part of the asymmetrical X-ray beam, which is exposed to a patient and which is achieved by bringing the X-ray absorbing plate into a certain position of the symmetrical X-ray beam or field, such that only an asymmetrical X-ray beam or field passes the area, where no X-ray absorbing plate is arranged, a definite area of the patient is exposed to X-ray radiation. Thus, with the inventive device the collimation can be adapted to the size of the patient by moving the X-ray absorbing plate into the preferred or appropriate vertical position. Thus, a so-called single-sided collimation is obtained by transferring the symmetrical X-ray beam into an asymmetrical X-ray beam.

The present invention is preferably applicable to C-arm systems and also systems with film cassettes, such that from their original symmetrical X-ray radiation the inventive asymmetrical X-ray radiation can be obtained.

At a C-arm system the tube and the detector are mounted on the same mechanics and can only be moved as a single unit. As a consequence an up- and down-movement of the tube with respect to the detector is at C-arm systems not possible. Thus, an aligned collimation, which varies the area and thus symmetrical part of the X-ray beam, as it is the case for high end X-ray-systems, is for C-arm systems not possible. However, with the add-on-X-ray-collimator for non-symmetrical beam collimation of the present invention it is possible to obtain an asymmetrical X-ray beam from a symmetrical X-ray beam in C-arm systems, as the X-ray absorbing plate of the add-on-X-ray-collimator is introduced as a further moveable component to the C-arm system.

Thus, a suitable upper alignment or lower alignment, for specific medical treatment, is possible for C-arm systems.

According to a second embodiment of the present invention, the housing of the device further comprises at least one attachment rail for attaching the housing on a X-ray collimator of a X-ray tube. With the attachment rail it is possible to bring the housing into connection with the collimator, such that a fixed and secure connection is obtained.

Thus, the advantage is obtained that the inventive device can in an easy manner be attached on a collimator of a X-ray system, which produces a symmetrical X-ray beam. As a consequence an asymmetrical X-ray beam or field can be obtained with the present invention.

According to a third embodiment of the present invention, the housing of the inventive device is fittable into a rail system of the X-ray collimator of a X-ray tube. As a rail system an arrangement is understood, which has at least two rails, into which the housing of the inventive device can be attached or fitted. With such a fittable device it is possible to align the device in a way such that an optimal alignment of an asymmetrical X-ray beam is achievable.

Thus, with the present invention the advantage is obtained that a uniform asymmetrical collimation or asymmetrical X-ray beam from a symmetrical X-ray beam is obtained.

According to a further embodiment of the present invention, the X-ray absorbing plate is moveable in a vertical direction.

Under the expression moveable in a vertical direction is preferably understood that the X-ray absorbing plate is moveable by means of the sleigh in the y-direction, see FIG. 1. The sleigh thereby moves along rails, which are mounted on the inventive device.

Thus, the advantage is obtained that an asymmetrical or non-symmetrical X-ray beam or radiation is obtained which can be applied to a predetermined area, i.e. a so-called "upper beam alignment" or "lower beam alignment" is obtained, whereas the later is less frequently used.

It is further preferred that at the most about 40% of the original symmetrical X-ray beam are covered by the X-ray absorbing plate in the direction of the detector, see FIG. 2. Thus, the advantage is obtained that the operation of an automatic exposure control (AEC) is not disturbed or interfered.

According to a further embodiment of the present invention, the housing further comprises a wheel for controlling the position of the X-ray absorbing plate of the inventive add-on-X-ray-collimator.

Under a wheel for controlling the position of the X-ray absorbing plate is preferably understood a device by means of which it is possible to change preferably the height of the X-ray absorbing plate in the y-direction or vertical direction. By means of the wheel for controlling the position of the X-ray absorbing plate it is also possible to vary the height of the X-ray absorbing plate preferably in the range of tenths or hundreds of a millimeter. The range is between zero millimeter and some centimeters with an accuracy of some of tenths of a millimeter.

It has to be noted that embodiments of the invention have been described with reference to different subject matters. In particular, some embodiments have been described with reference to apparatus type claims whereas other embodiments have been described with reference to method type claims. However, a person skilled in the art will gather from the above and the following description that, unless other notified, in addition to any combination of features belonging to one type of subject matter also any combination between features relating to different subject matters, in particular between features of the apparatus type claims and features of the method type claims is considered to be disclosed with this application.

The aspects defined above and further aspects of the present invention are apparent from the examples of embodiment to be described hereinafter and are explained with reference to the examples of embodiment. The invention will be described in more detail hereinafter with reference to examples of embodiment but to which the invention is not limited.

Thus, with the present invention the advantage is obtained that the X-ray absorbing plate can be positioned very exactly in a vertical position, such that the asymmetrical X-ray beam is applied to the patient in a well defined and preferred area, whereas an upper or lower beam alignment is obtained.

For a better understanding of the above features and advantages of the invention, embodiments will now be described, purely by way of example, with reference to the accompanying drawings in which.

The illustration in the drawing is schematically. It is noted that in different figures, similar or identical elements are provided with the same reference signs.

Figure 1:
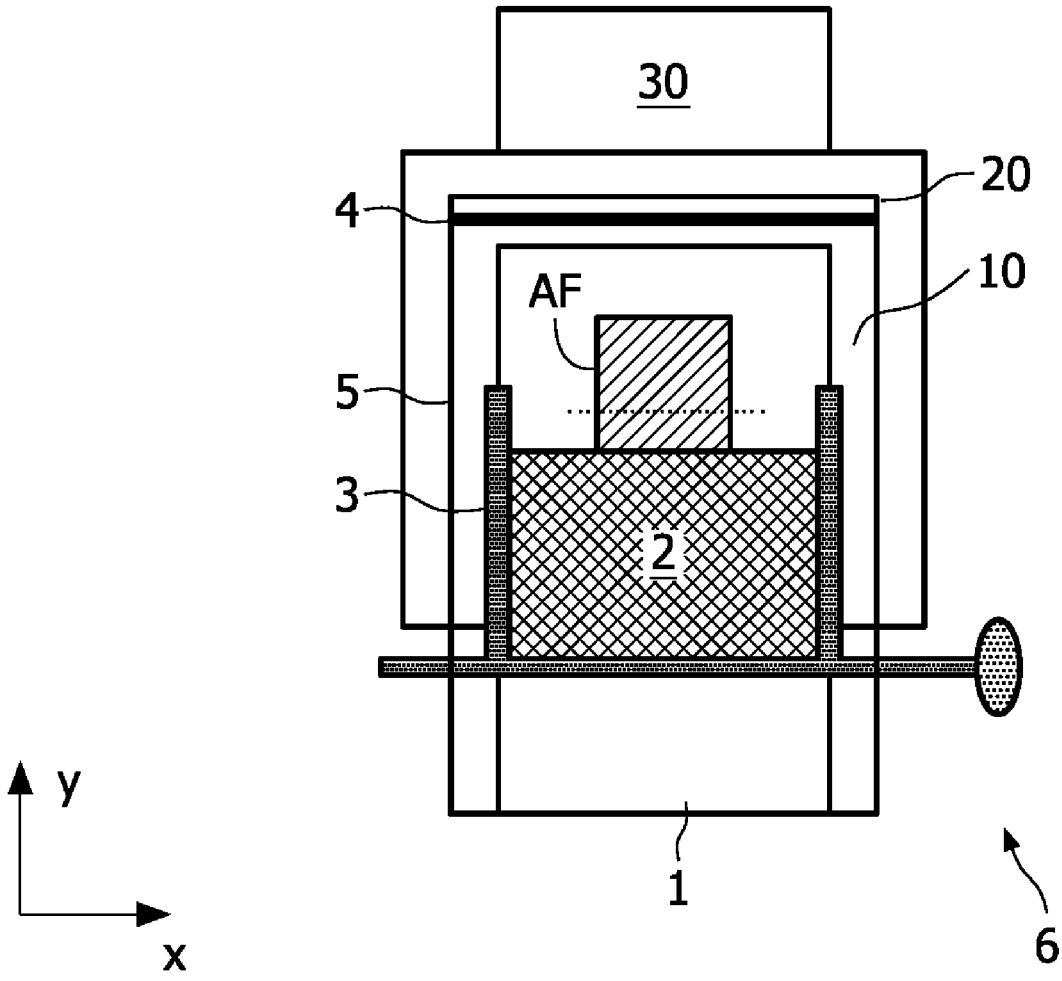
FIG. 1 shows a cross section of the device for a non-symmetrical X-ray beam collimation according to the invention.

In FIG. 1 a cross section of the inventive device 10 for producing an asymmetrical X-ray beam is shown.

The inventive device 10, which is an add-on-X-ray-collimator for non-symmetrical beam collimation, comprises as main components a housing 1, a X-ray absorbing plate 2, which is a lead plate and a sleigh 3.

The housing 1 of the inventive device 10 is attached by means of an attachment rail 4 on the front side of on a X-ray collimator 20 of a X-ray tube 30, whereas the front side of the collimator 20 is directed to a detector (not shown) of the X-ray system.

The lead plate 2 is connected with the sleigh 3 in order to be moveable along a rail system 5.

By means of a wheel 6 the lead plate is moveable in the y-direction.

Without the inventive device 10 the X-ray tube 30 is emitting a symmetrical X-ray beam or radiation.

Such a symmetrical X-ray radiation is symmetrically distributed from the X-ray tube 30 to the detector (not shown), see spotted line in rectangular AF.

By attaching the inventive device 10 with the housing 1 and the lead plate 2 in front of the collimator 20 of a X-ray tube 30 a part of the symmetrical X-ray beam is exposed to the lead plate and can not pass to the detector (not shown) such that an asymmetrical or non-symmetrical X-ray beam or radiation is created.

By means of the wheel 6 the lead plate can be moved in the y-direction up or down such that an upper beam alignment or a lower beam alignment of the X-ray beam and thus a collimation in a defined area is achieved. Thus, a well defined upper or lower area of a patient is irradiated, see FIG. 2.

Figure 2:
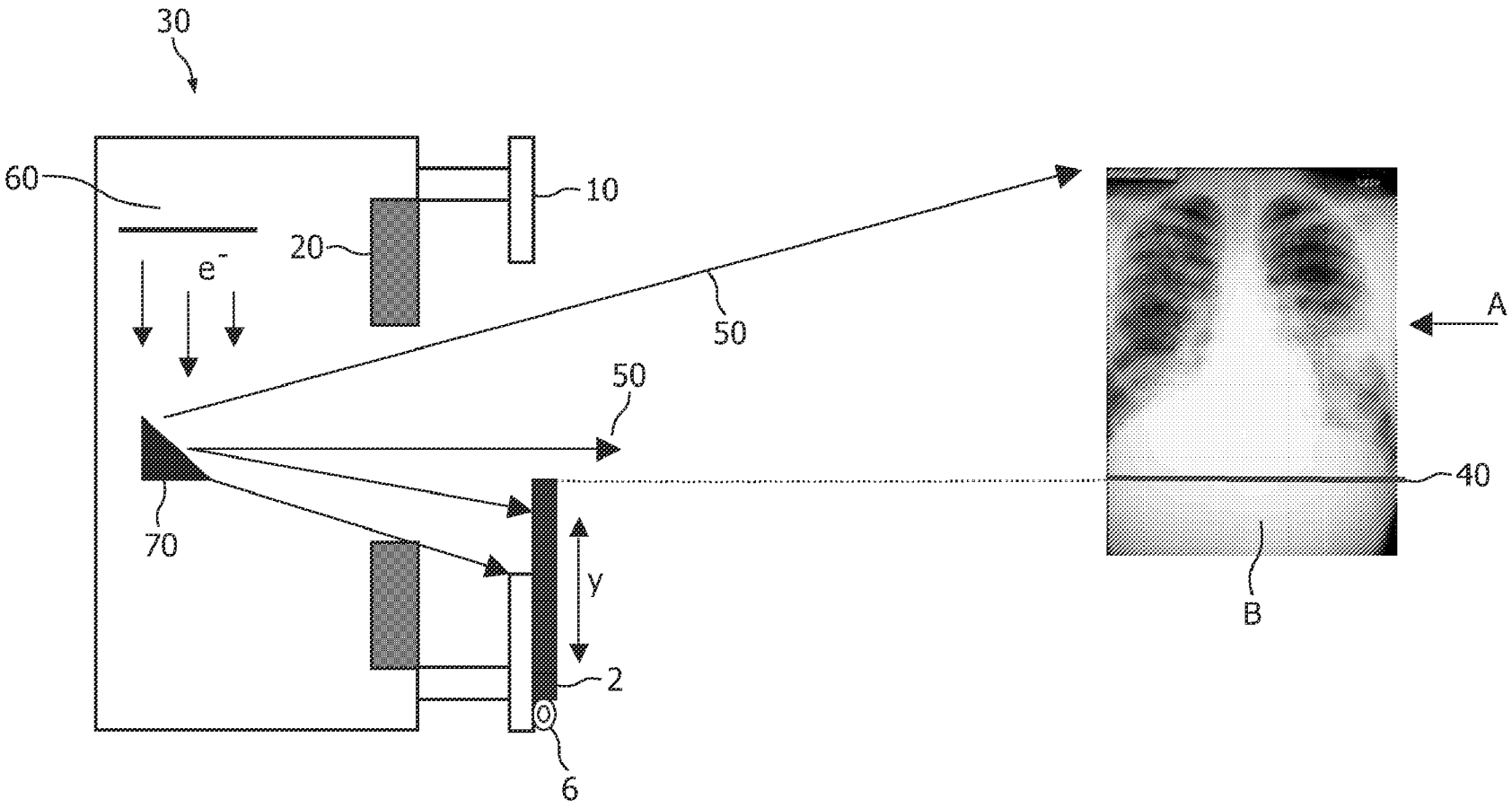
FIG. 2 shows a side-view of a X-ray tube with the inventive add-on-X-ray collimator and an example of a X-ray image of a collimated chest of a patient.

In FIG. 2 a side-view of the X-ray tube 30, the collimator 20 of the X-ray tube 30 and the inventive device 10, which is the add-on-X-ray-collimator, are shown.

In the X-ray tube 30 electrons $e^-$ are produced by a cathode 60 which are accelerated to an anode 70, where X-rays are emitted. The X-rays pass the collimator 20, which is part of the X-ray tube 30 and which produces symmetrical X-ray beams 50.

In front of the collimator 20 of the X-ray tube 30 the inventive add-on-X-ray-collimator 10 with the housing, sleigh and lead plate 2 is mounted. By means of a wheel 6 the vertical height y of the lead plate 2 can be changed, see up-and-down-arrow. Thus, an asymmetrical X-ray beam is emitted after the symmetrical X-ray beam has passed the lead plate 2 of the inventive add-on-X-ray collimator 10.

Further, on the right side of FIG. 2 an exemplary X-ray image of a human chest is shown. Thereby, in the upper part A of the image, which corresponds to the upper alignment, the human chest is irradiated by the asymmetrical X-ray beams 50.

The lead plate 2 prevents a transmission of X-rays of the symmetrical X-ray beam, such that an asymmetrical X-ray beam is obtained. Thus, the lower part B, which is separated from the upper part A by an edge of the lead plate 40 is not irradiated by X-rays.

Therefore an adequate X-ray protection of the human body is obtained in an easy and cheap way by the add-on-X-ray-collimator 10 of the present invention.

It should be noted that the term "comprising" does not exclude other elements or steps and the "a" or "an" does not exclude a plurality. Also elements described in association with different embodiments may be combined. It should also be noted that reference signs in the claims should not be construed as limiting the scope of the claims.

In order to recapitulate the above described embodiments of the present invention one can state that with the present invention the advantage is obtained that the lead plate can be positioned very exactly in a vertical position, such that the asymmetrical X-ray beam is applied to the patient in a well defined and preferred area, whereas an upper or lower beam alignment is obtained.

The invention claimed is:

1. A device for non-symmetrical X-ray beam collimation of a symmetrical X-ray beam from an X-ray tube in a C-arm X-ray system, wherein the X-ray tube is at least partially enclosed in a housing comprising a first collimator attached to the housing, the first collimator defining an opening through which passes the symmetrical X-ray beam from the X-ray tube, wherein the device is attached to the first collimator, the device comprising a second collimator for non-symmetrical X-ray beam collimation of the X-ray beam exiting the first collimator, the second collimator comprising:

a) an X-ray absorbing plate for asymmetrically collimating the X-ray beam exiting the first collimator;

b) a sleigh, wherein the X-ray absorbing plate is movably attached to the sleigh for moving the X-ray absorbing plate in increments of tenths of a millimeter;

wherein the housing is movably attached to a rail system for moving the housing to align the housing with respect to the detector.

2. The device of claim 1, wherein the rail system has two rails.

3. The device of claim 1, wherein the X-ray absorbing plate blocks at most 40% of the X-ray beam exiting the first collimator.

4. An X-ray radiography system with automatic exposure control comprising the device of claim 1.

* * * * *